US005235730A

United States Patent [19]

Townsend

[11] Patent Number: 5,235,730

[45] Date of Patent: Aug. 17, 1993

[54] CONCEALED NECKTIE HOLDING DEVICE

[76] Inventor: Sue A. Townsend, P.O. Box 454, Tuckahoe, N.Y. 10707-0454

[21] Appl. No.: 980,249

[22] Filed: Nov. 23, 1992

[51] Int. Cl.[5] ..... A41D 25/00

[52] U.S. Cl. ..... 24/49 R; 24/49 CF; 24/56

[58] Field of Search ..... 24/49 R, 49 CF, 49 CC, 24/49 C, 54, 56, 67.9, 546, 555, 547, 548, 551

[56] References Cited

U.S. PATENT DOCUMENTS

| | | | |
|---|---|---|---|
| 3,968,544 | 4/1976 | Sinclair | 24/49 CF |
| 5,007,139 | 4/1991 | Ahern | 24/49 CF |
| 5,031,284 | 7/1991 | Ray | 24/49 R |
| 5,031,285 | 7/1991 | Wallo | 24/49 R |
| 5,046,221 | 9/1991 | Walker | 24/49 R |

*Primary Examiner*—Victor N. Sakran

[57] ABSTRACT

A completely concealed necktie holding device is constructed in a manner such that is attached to the shirt via a button hole engagement cross-bar and attached to the necktie via a clamp. In between the buttonhole engagement cross-bar and the clamp is a rectangular shaped holding device through which the narrow back panel of the necktie is inserted. Once engaged, the tie clamp holds the front and back panels of the necktie in place centered above the buttons on the wearer's shirt permitting limited vertical and horizontal movement. Since no adhesives, pins or similar fastening devices are attached directly onto the fabric of the necktie, there is virtually no possibility of damage to the necktie from use of the tie clamp.

5 Claims, 3 Drawing Sheets

CONCEALED NECKTIE HOLDING DEVICE

BACKGROUND OF INVENTION

1. Field of the Invention

The present invention relates to a holding device used to secure a 4-in-hand necktie in place along the front portion of the wearer's shirt and more particularly to such a device that remains concealed during use and doesn't pose a threat of damaging the fabric of the necktie with he use of adhesives, pins, alligator clips or the like.

2. Prior Art

A 4-in-hand necktie generally has two panels which comprise a wide end portion and a narrow end portion. When worn, the narrow end panel is located behind the wide end panel, and held in front of the buttons of the wearer's shirt by a tie tack, tie clasp or other device.

Many such devices have been disclosed for the purpose of securing 4-in-hand neckties. There are two basic types of such devices; those which are concealed during use and those which are worn on the outside of the tie, usually as a jewelry object.

Some forms of devices known of the art for securing neck-tie panels and remain concealed can be found in U.S. Pat. Nos. 4,920,579; 4,099,300; and 4,655,375. Such devices restrict the movement of the wearer, due to the fact that they either employ alligator type clips that clamp the tie and/or devise onto the shirt, are constructed of hard plastic which makes it relatively flat and inflexible, or when engaged, does not leave sufficient room for the tie to "slide" with the wearer's movement. This restricted movement may result in discomfort of the wearer due to the fact that since tie clasp is so stringently affixed to the wearer's shirt, the tie can pull on the wearer's neck or shirt during certain movement.

Other forms of devices can be found in U.S. Pat. Nos. 3,467,993; 4,554,710; and 4,827,576. These devices use adhesives to hold the tie panels in place or even require that a permanent structure be attached to the tie. These pose disadvantages, since the adhesives will eventually wear out and the permanent structure may become dislodged during dry-cleaning. The most obvious disadvantage of these devices, however, is that they can cause damage to the delicate and often expensive fabrics that neckties are made of.

Whatever the precise merits, features and advantages of the above cited references, none singly provides all of the objectives of the present invention.

SUMMARY OF THE INVENTION

A general object of the present invention is to provide a tie-holding device which remains hidden during use.

Another object of this invention is to provide a tie-holding device that will not damage any of the surfaces of the tie or alter the tie in any way.

Another object of this invention is that while the device is flexible in construction, it secures the necktie panels in back of one another and provides for movement of the necktie panels as not to cause discomfort to or restrict the movement of the wearer.

Another object of this invention is to provide a design that is a single object, being one piece, that is simple and easy to use, and will remain securely in place once engaged.

Another object of this invention is to be manufactured in such a way as it is relatively inexpensive.

DETAILED DESCRIPTION

Figure 1:
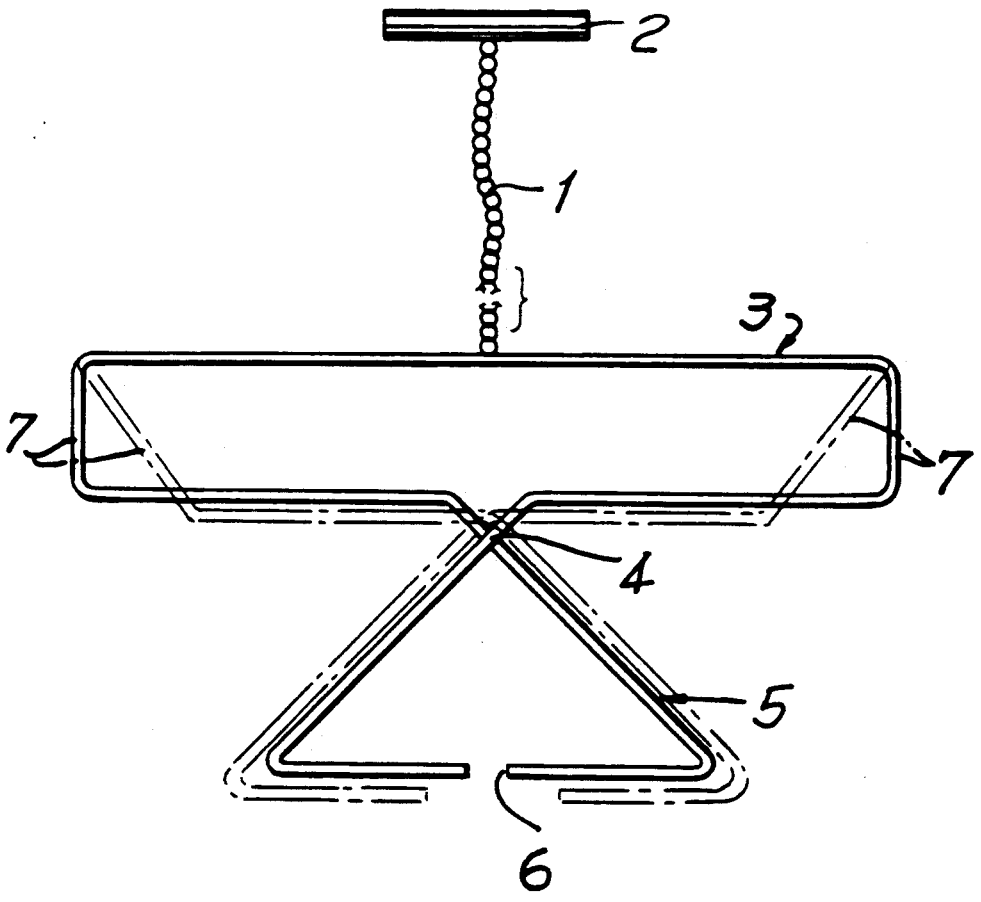
FIG. 1 An overall drawing of the invention.

Refer to FIG. 1, which is an overall drawing of a preferred embodiment of the invention. As shown in FIG. 1, the invention is a relatively simple apparatus consisting of one piece. The invention is made up of a short elongated flexible member such as a chain 1 with a cross-bar 2 attached to one end. Attached to the other end of the flexible member 1 is a rectangular shaped holding device 3 which is made of a solid metal wire. In the center of the long side of the rectangle furthest from the chain, the metal wire crisscrosses 4 and forms a triangular shaped apparatus 5. At the base of the triangular shaped apparatus 5, the metal remains detached, thus forming a clamp 6 that attaches to the rear fold of the wide panel of the necktie. The clamp is activated by pressing on the two short sides 7 of the rectangular holding device simultaneously. The short elongated flexible member 1, cross-bar 2, rectangular holding device 3 and triangular shaped apparatus 5, are permanently affixed to each other.

Figure 2:
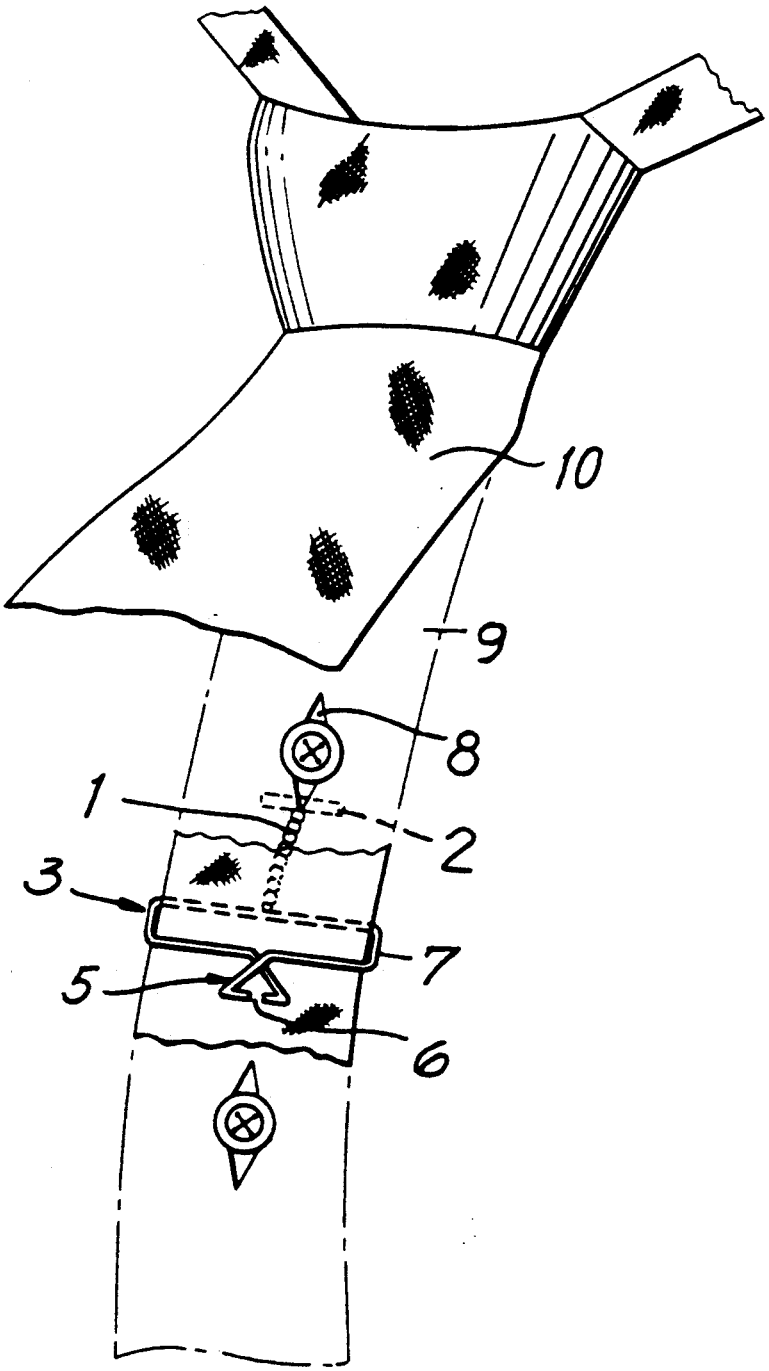
FIG. 2 Front view of the invention fastened to the wearer's shirt and narrow panel of tie.

Referring now to FIG. 2, there is shown the invention partially engaged. The invention includes a bar rod 2 which is designed to be inserted through a shirt button hole 8 and retained therein by proper orientation thereof. The bar rod 2 can be constructed of any material suitable for the purpose intended. Some degree of rigidity is required.

The bar rod 2 is attached to an elongated flexible member 1. This elongated flexible member 1 is preferably constructed of a material such as linked chain, or may be constructed of any other pliable material such as thread or the like. The elongated flexible member 1 is fixedly connected at one end to the bar rod 2. This attachment may be connected to an aperture through the bar rod 2 or by an integrally formed bar rod and elongated flexible member as by casting or the like.

The neck tie is arranged so that the rear necktie panel 9 and front necktie panel 10 drape properly and relative to the shirt front. The rear panel 9 which is more narrow that the front panel 10 is inserted through the rectangular holding devise 3, thus holding the narrow tie panel 9 in place in front of the wearer's shirt.

Figure 3:
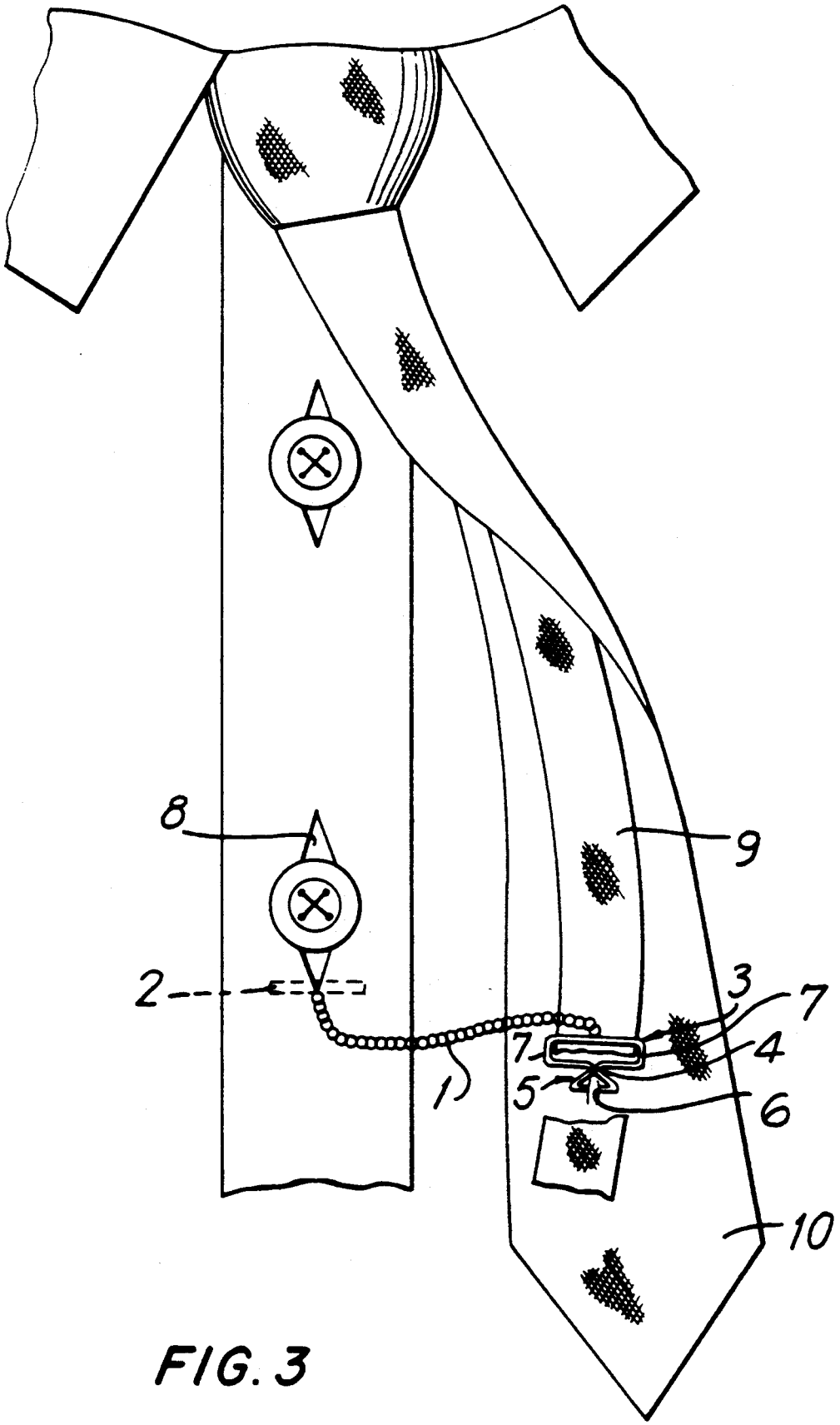
FIG. 3 View of the invention fully engaged.

As seen in FIG. 3, once the button rod 2 is engaged and the narrow necktie panel 9 is inserted through the rectangular holding device 3, the clamp 6 which is formed in the center of the base of the triangular apparatus 5, is affixed to the rear fold of the wide necktie panel 10. Once affixed, the device holds the front tie panel 10 directly in front of the rear tie panel 9, and remains concealed behind the necktie. The clamp 5 is designed so that said clamp attaches to the rear fold of the wide panel of the necktie in such a way that it poses no possibility of damaging the fabric of the necktie.

Once engaged, the necktie panels 9 and 10 are held in place with the rear narrow necktie panel 9 positioned behind the front wider necktie panel 10. The necktie panels 9 and 10, while held in place relative to each other, are permitted some movement independently of and relative to the wearer's shirt front, due to the length of the elongated flexible member 1. This permits the tie to drape naturally and also provides comfort by allowing the wearer to move about without the tie pulling on the wearer's shirt and/or neck. At the same time, the entire device remains concealed behind the necktie during use.

The foregoing description of the preferred embodiment of the invention has been presented for the purpose of illustration and description. It is not intended to be exhaustive or to limit the invention to the precise form disclosed. Many modifications and variations are possible in light of the above teaching. It is intended that the scope of the invention be limited no by this detailed description, but rather than by the claims appended hereto.

What is claimed is:

1. A tie engaging device for holding the wide front necktie panel and the narrow rear necktie panel of a 4-in-hand tie in place relative to a wearer's shirt comprising: a button hole engagement cross-bar as fastening means to the wearer's shirt, and elongated flexible member extending from said cross-bar and attached to a rectangular holding apparatus through which the narrow, rear tie panel is positioned; a clamp apparatus which is formed by extending the far sides of the rectangular holding apparatus, criss-crossing the wire thus forming a triangular shaped apparatus that when activated, performs as a clamp to affix to the rear fold of the wide front panel of the necktie.

2. The combination of claim 1 in which said elongated flexible member, cross-bar, rectangular holding device and triangular shaped apparatus are permanently attached to each other.

3. The combination of claim 1 in which the entire device remains concealed behind the tie during use.

4. The invention as described in claim 1 wherein said clamp attaches to the rear fold of the wide panel of the necktie in such a way that it poses no possibility of damaging the fabric of the necktie.

5. The invention as described in claim 1 wherein said elongated flexible member allows restricted movement of the tie relative to the front of the wearer's shirt.

* * * * *